US006443091B1

(12) United States Patent
Matte

(10) Patent No.: US 6,443,091 B1
(45) Date of Patent: Sep. 3, 2002

(54) DRAIN ALERT DEVICE

(76) Inventor: Marco F. Matte, 7834 McHost Rd., Zachary, LA (US) 70791

( * ) Notice: Subject to any disclaimer, the term of this patent is extended or adjusted under 35 U.S.C. 154(b) by 0 days.

(21) Appl. No.: 09/442,846

(22) Filed: Nov. 18, 1999

(51) Int. Cl.[7] ..... D06F 37/42
(52) U.S. Cl. ..... 116/228; 68/208; 340/618
(58) Field of Search ..... 116/228, 264, 116/266, 272, 273, 281, DIG. 7, 268, 227; 340/616, 624, 604, 605, 618, 623; 137/360, 558; 68/208

(56) References Cited

U.S. PATENT DOCUMENTS

| | | | | | |
|---|---|---|---|---|---|
| 2,985,187 | A | | 5/1961 | Hamilton | |
| 3,185,789 | A | | 5/1965 | Gunther | |
| 3,255,324 | A | | 6/1966 | Ovshinsky | |
| 3,264,627 | A | | 8/1966 | Austin | |
| 3,464,437 | A | | 9/1969 | Zane | |
| 3,675,448 | A | * | 7/1972 | Smith | 68/208 |
| 4,069,837 | A | | 1/1978 | Jirasek | 137/360 |
| 4,080,985 | A | | 3/1978 | Eagle | 137/425 |
| 4,147,060 | A | * | 4/1979 | Fling et al. | |
| 4,255,747 | A | * | 3/1981 | Bunia | 340/624 |
| 4,380,243 | A | | 4/1983 | Braley | 340/616 |
| 4,398,186 | A | | 8/1983 | Statz | 340/616 |
| 4,922,234 | A | * | 5/1990 | Murphy | 340/608 |
| 4,930,552 | A | * | 6/1990 | Estep | 137/362 |
| 5,007,450 | A | * | 4/1991 | Babb et al. | 137/315 |
| 5,028,910 | A | | 7/1991 | Meacham | 340/616 |
| 5,125,247 | A | | 6/1992 | Mills | 68/208 |
| 5,303,566 | A | * | 4/1994 | Wolney et al. | 68/208 |
| 5,552,774 | A | * | 9/1996 | Gridley | 340/623 |
| 5,632,302 | A | * | 5/1997 | Lenoir, Jr. | 137/312 |
| 5,898,375 | A | * | 4/1999 | Patterson | 340/612 |
| 5,983,908 | A | * | 11/1999 | Bradley | 134/57 D |
| 6,237,537 | B1 | * | 5/2001 | Winchester | 119/673 |

FOREIGN PATENT DOCUMENTS

| | | | | |
|---|---|---|---|---|
| JP | 58160819 | A * | 9/1983 | 116/228 |

* cited by examiner

*Primary Examiner*—Diego Gutierrez
*Assistant Examiner*—Gail Verbitsky
(74) *Attorney, Agent, or Firm*—Kean, Miller, Hawthorne, D'Armond, McCowan & Jarman L.L.P.

(57) ABSTRACT

A drain alert device for detecting an overflow condition in a drainage system having a drain conduit, wherein wastewater is received through an inlet of the drain conduit, is provided, comprising an overflow conduit extending horizontally from the drain conduit below the inlet. The overflow conduit leads to an overflow detection device which includes a vessel having an internal volume sufficient to contain an amount of overflow wastewater. A buoyant member having an elongated, substantially vertical, overflow indicator resides within the vessel, and the overflow indicator is guided by a guide tube extending above the vessel. Thus, the overflow indicator reveals the extent of an overflow condition by protruding through the guide tube in response to the level of wastewater within the vessel. The vessel further includes a drain port having a threaded coupling capable of receiving a conventional flexible hose so that the appliance may be operated despite obstructions in the drain conduit. Optionally, the overflow conduit includes a device for partially impeding the flow of wastewater through the overflow conduit into the vessel to minimize false alerts due to splashing of wastewater during normal drainage.

11 Claims, 1 Drawing Sheet

DRAIN ALERT DEVICE

BACKGROUND OF THE INVENTION

I. Field of the Invention

The present invention relates generally to devices employed to alert a person to an overflow condition within a drainage system, and more particularly to those devices used with home appliances, such as washing machines and dishwashers.

II. Description of Prior Art

One of the more evident problems with automatic washing machines is the occasional wastewater overflow which occurs due to obstructions in the drain line. Because the user is typically not near the washing machine when the overflow occurs, the back up of wastewater from the drain line during the spin cycle can result in a substantial amount of spillage onto the surrounding floor area. Such an event causes much inconvenience in having to mop up the excess wastewater underneath the washing machine, not to mention the possibility of damage to other nearby articles that may be soaked with water.

In the experience of the inventor, clogging of the drain line is not typically an immediate event, but rather results over a long period of time from the frequent use of the washing machine. While a total clogging and overflow may sometimes occur, it is more likely that the drain path is only partially obstructed. This condition usually results in the slow drainage of wastewater or a backup of wastewater toward the end of a drain cycle. Automated solutions to such problems as seen in the prior art involve relatively complex feedback systems requiring electrical power. Furthermore, the occurrence of an overflow with those systems will generally cause the washing machine to shut off entirely. While this is admittedly effective in preventing the overflow, it also interrupts the washing cycle and thereby causes its own inconveniences to the user. Unless and until the clog is eliminated, such as by the services of a plumber, the washing machine is essentially unuseable.

What is needed, therefore, is a drain alert device that provides a visual indication of an overflow condition, but which still allows the user to continue using the washing machine or other appliance. Such a device should be simple to install as a retrofit to existing appliance drain systems. It should also require no electrical power and employ as few moving parts as possible. From the ensuing description of the preferred embodiments, it will become apparent that the present invention meets this need in a manner that is unique and more advantageous in comparison to prior art devices.

SUMMARY OF THE INVENTION

It is therefore an object of this invention to provide a drain alert device for use with appliance drainage systems that provides a visual indication of an overflow condition.

It is also an object of this invention to provide a drain alert device that can be easily retrofitted to existing appliance drainage systems.

It is a further object of this invention to provide a drain alert device that requires no electrical power and only a single moving part.

Yet another object of this invention is to provide a drain alert device that minimizes the occurrence of false alerts due to splashing during normal drainage.

Still another object of the present invention is to provide a drain alert device that allows the user to continue using the appliance after the alert has been received and until the overflow problems have been corrected.

These and other objects and advantages of the present invention will no doubt become apparent to those skilled in the art after having read the following description of the preferred embodiment which are contained in and illustrated by the various drawing figures.

Therefore, in a preferred embodiment, a drain alert device for detecting an overflow condition in a drainage system having a drain conduit, wherein wastewater is received through an inlet of the drain conduit, is provided, comprising an overflow conduit having a first end and a second end, wherein the first end is fluidically connected to the drain conduit below the inlet; an overflow detection device fluidically connected to the second end of the overflow conduit, wherein the overflow detection device includes a vessel having an internal volume sufficient to contain a predetermined amount of the wastewater from the overflow conduit, a buoyant member residing within the vessel, and an overflow indicator operatively attached to the buoyant member; wherein the buoyant member is caused to move the overflow indicator in response to the level of wastewater in the vessel.

In a more preferred embodiment, the overflow conduit includes a device for partially impeding the flow of wastewater through the overflow conduit into the vessel to minimize false alerts due to splashing of wastewater during normal drainage. One specific manner of accomplishing this is a raised portion of the overflow conduit, wherein the raised portion is higher than the first end of the overflow conduit.

Preferably, the vessel includes a bottom surface, a top surface, and a first opening in the top surface for receiving the second end of the overflow conduit. More preferably, the top surface of the vessel further includes a second opening also capable of receiving the second end of the overflow conduit in the event that the invention is installed opposite the side of the first opening.

The vessel further includes a drain port having a threaded coupling capable of receiving a conventional flexible hose so that the appliance may be operated despite obstructions in the drain conduit. A guiding device is also included with the vessel for guiding the overflow indicator during movement thereof in response to the level of the wastewater within the vessel.

In a specific embodiment, the buoyant member is constructed from a hollow sealed plastic material or from a plastic foam insulation material. The overflow indicator preferably comprises an elongated rigid member extending from the buoyant member within the guiding device. The overflow indicator further includes visual indicia for indicating that an overflow condition has occurred, and also the extent of the overflow, by the protrusion of the overflow indicator from the guiding device.

DETAILED DESCRIPTION OF THE PREFERRED EMBODIMENTS

Figure 1:
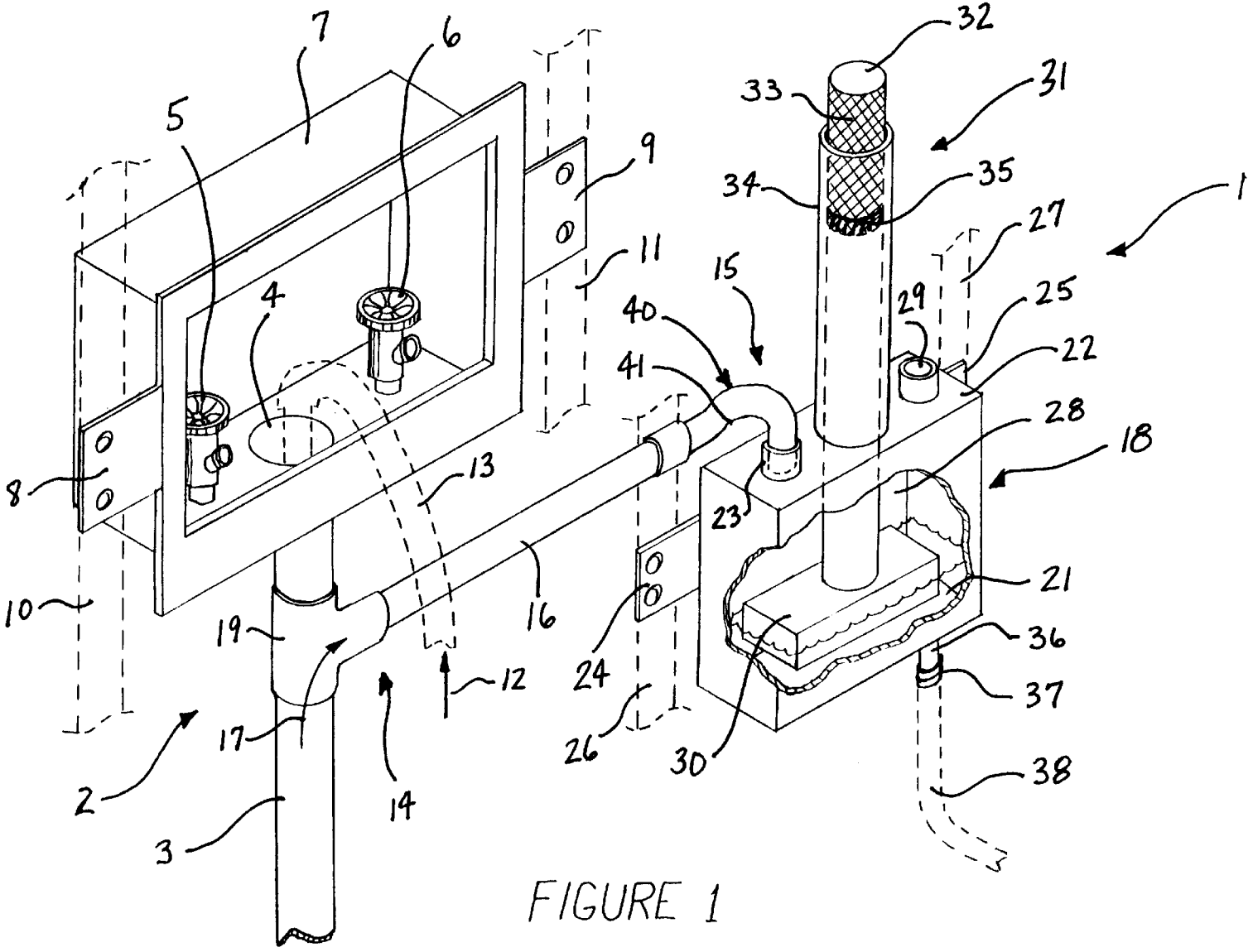
FIG. 1 is a perspective view of a preferred embodiment of the present invention, depicting the overflow conduit and overflow detection device.

In the drawings many details pertaining to fabrication and maintenance utility well established in the plumbing art and not bearing upon points of novelty are omitted in the interest of descriptive clarity and efficiency. Such details may include threaded connections, standard fittings, seals, and the like. While such details are essential to overall function, they are largely matters of designer's choice, are not claimed and, hence, not shown. It should be further understood that the figures are not necessarily drawn to scale, and that dimensions specified herein are for illustration of the specific embodiments described herein. Unless otherwise indicated, all materials of construction are plastic, such as polyvinyl chloride (PVC), and are attached to one another by suitable adhesives well known to those of ordinary skill in the plumbing field.

Turning now to FIG. 1, a preferred embodiment of the invention is shown. The invention pertains to a drain alert device 1 for detecting an overflow condition in a drainage system 2 having a drain conduit 3, wherein wastewater is received through an inlet 4 of the drain conduit 3. The particular drainage system 2 shown is typically employed with an automatic washing machine (not shown), wherein the drainage system 2 comprises hot and cold water taps 5, 6 located within a housing 7. Housing 7 is mounted in a recessed manner to a wall by opposing flanges 8, 9 which are connected to wall studs 10, 11. During operation of the washing machine, wastewater 12 exiting the washing machine enters a wastewater conduit 13 in fluidic communication with the inlet 4 of the drain conduit 3. In the absence of the present invention, any obstruction in the drain conduit 3 or in the downstream sewerage piping system may result in the reversal of flow within the drain conduit 3, leading to a possible overflow condition from the inlet 4 with all of the problems attendant thereto.

To avert such problems, an overflow conduit 16 having a first end 14 and a second end 15 is provided to divert backed-up wastewater 17 to an overflow detection device 18, as will be explained below. Preferably, the first end 14 of the overflow conduit 16 is fluidically connected to the drain conduit 3 below the inlet 4 using a standard T-fitting 19, and is oriented in a substantially horizontal position. The second end 15 of the overflow conduit 16 is fluidically connected to the overflow detection device 18. The overflow detection device 18 preferably includes a vessel 20 having an internal volume sufficient to contain a predetermined amount of backed-up wastewater 17 flowing from the overflow conduit 16. The vessel 20 includes a bottom surface 21, a top surface 22, and a first opening 23 in the top surface 22 for receiving the second end 15 of the overflow conduit 16. The vessel 20 is mounted to the wall by opposing flanges 24, 25 attached to wall studs 26, 27, similar in fashion to the housing 7 of the drainage system 2. Note that the flanges 24, 25 are located near the back wall 28 of the vessel 20 so that the overflow detection device 18 may be mounted flush to the wall. The ability to accommodate a flush mount arrangement thereby enables one to retrofit existing appliance drainage systems 2 with the present invention with very little effort and without undue destructive work to the wall.

More preferably, the top surface 22 of the vessel 20 further includes a second opening 29 opposite first opening 23 also capable of receiving the second end 15 of the overflow conduit 16. The presence of the second opening 29 is particularly advantageous when the overflow detection device 18 and overflow conduit 16 must be mounted on the opposite side of the drainage system 2 than that shown in FIG. 1.

In order to alert the user to an overflow condition, vessel 20 contains a buoyant member 30 connected to an overflow indicator 31. Overflow indicator 31 preferably comprises an elongated, substantially vertical, rigid member 32 extending from the buoyant member 30, and further includes visual indicia 33, such as a brightly colored region, for indicating an overflow condition. Optionally, visual indicia 33 may also include a "full" indicator 35 for signaling to the user that the buoyant member 30 has reached its maximum height and that vessel 20 is incapable of holding any more wastewater 17. Buoyant member 30 normally rests on the bottom surface 21 of vessel 20 when no backed-up wastewater 17 is present within vessel 20. Upon the accumulation of backed-up wastewater 17 within vessel 20, buoyant member 30 is caused to move in an upward direction, also causing the overflow indicator 31 to rise in response to the level of wastewater 17 in the vessel 20. While the particular size and shape of the buoyant member 30 is not critical, its buoyancy must be sufficient to raise the combined weight of buoyant member 30 and overflow indicator 31 upon the accumulation of a relatively small amount of wastewater 17. In so doing, the user will be alerted to obstructions in the drain conduit 3 at the earliest possible time. Both buoyant member 30 and overflow indicator 31 are preferably constructed from a suitable low density material, such as plastic foam insulation similar to the products manufactured under the trademark Styrofoam® by the Dow Chemical Company. Alternatively, buoyant member 30 and overflow indicator 31 may be constructed from a sealed hollow plastic material.

To assist in alerting a user, vessel 20 further includes guiding means 34, such as a hollow tube, for guiding the overflow indicator 31 during movement of the overflow indicator 31 in response to the level of the wastewater 17 in vessel 20. Because the height of the overflow detection device 18 must necessarily be below the level of the inlet 4, it is desirable for the overflow indicator 31 to be of sufficient height to enable easy viewing if located behind the appliance. Thus, guiding means 34 should extend high enough behind the appliance such that the top of the overflow indicator 31 and the visual indicia 33 can be seen. In the configuration shown in FIG. 1, the visual indicia 33 is normally completely hidden and flush with the top of the guiding means 34 when no wastewater 17 is present within the vessel 20. As the wastewater level rises and the visual indicia 33 is exposed above the guiding means 34, the user is able to see not only that an overflow condition is present, but also the extent to which overflow wastewater 17 has already backed up into the vessel 20, providing a sense of how severe the problem may be.

For draining the vessel 20 after an overflow condition, the vessel 20 further includes a drain port 36 having a threaded coupling 37 capable of receiving a conventional flexible hose 38. Moreover, the presence of the drain port 36 also allows the appliance to be operated and drained despite the overflow condition by directing the opposite end of the hose 38 to the outside of the home or into any suitably large reservoir for containing the wastewater 17.

Although not expressly required for operation of the present invention, it is preferred that the overflow conduit 16 also include means 40 for partially impeding the flow of backed up wastewater 17 to the vessel 20. The purpose of partially impeding the flow is to prevent the slow accumulation of wastewater 17 that may splash into the overflow conduit 16 during the normal, unobstructed drainage through the drain conduit 3. As shown in FIG. 1, means 40 may comprise a curved or raised portion 41 of the overflow conduit 16, wherein the raised portion 41 is slightly higher than the first end 14 of the overflow conduit 16. In most applications, the height differential for raised portion 41 from first end 14 should be approximately 0.2–0.5 inches. As an alternative to the shape of the overflow conduit 16, the means for partially impeding the flow may also comprise a small obstruction or weir (not shown) within an otherwise straight overflow conduit 16 such that small incidental amounts of wastewater 17 do not enter the vessel 20.

Although the present invention has been described in terms of specific embodiments, it is anticipated that alterations and modifications thereof will no doubt become apparent to those skilled in the art. For example, the invention is applicable to any appliance drainage system where possibility of overflow in the drain conduit may result in overflows, such as in the case of dishwasher drain systems. It is therefore intended that the following claims be interpreted as covering all such alterations and modifications as fall within the true spirit and scope of the invention.

I claim:

1. A drain alert device for detecting an overflow condition in a drainage system having a drain conduit, wherein wastewater is received through an inlet of said rain conduit, comprising:

(a) an overflow conduit having a first and a second end, wherein said first end is fluidically connected to said drain conduit below said inlet;

(b) an overflow detection device fluidically connected to said second end of said overflow conduit, wherein said overflow detection device including:

(i) a vessel having an internal volume sufficient to contain a predetermined amount of said wastewater of said wastewater from said overflow conduit, said vessel further including a drain port having a coupling capable of receiving a conventional flexible hose, said drain port providing an additional outlet for drainage should said conduit become clogged;

(ii) a buoyant member residing within said vessel; and (iii) an overflow indicator operatively attached to said buoyant member; wherein said buoyant member is caused to move said overflow indicator in response to the level of wastewater in said vessel.

2. The device of claim 1, wherein said vessel further includes guiding means for guiding said overflow indicator during movement of said overflow indicator in response to said level of said wastewater.

3. The device of claim 1, wherein said buoyant member is constructed from a hollow sealed plastic material.

4. The device of claim 1, wherein said buoyant member is constructed from a plastic foam insulation material.

5. The device of claim 1, wherein said overflow indicator comprises an elongated rigid member extending from said buoyant member, and wherein said overflow indicator further includes visual indicia for indicating an overflow condition.

6. The device of claim 2, wherein said overflow indicator comprises an elongated rigid member extending from said buoyant member, and wherein said rigid member further includes visual indicia for indicating an overflow condition when said visual indicia rises above said guiding means.

7. The device of claim 1 wherein said vessel can hold at least two gallons of water.

8. The device of claim 1, wherein said overflow conduit includes means for partially impeding the flow of said wastewater through said overflow conduit into said vessel.

9. The device of claim 8, wherein said means for partially impeding the flow of said wastewater comprises:

a raised portion of said overflow conduit, wherein said raised portion is higher than said first end of said overflow conduit; and a descending portion following said raised portion.

10. A drain alert device for detecting an overflow condition in a drainage system having a drain conduit, wherein wastewater is received through an inlet of said rain conduit, comprising:

(a) an overflow conduit having a first and a second end, wherein said first end is fluidically connected to said rain conduit below said inlet;

(b) an overflow detection device fluidically connected to said second end of said overflow conduit, wherein said overflow detection device includes:

(i) a vessel having an internal volume sufficient to contain a predetermined amount of said wastewater of said wastewater from said overflow conduit, said vessel further includes a bottom surface, a top surface, and a first opening in said top surface for receiving said second end of said overflow conduit;

(ii) a buoyant member residing within said vessel; and (iii) an overflow indicator operatively attached to said buoyant member; wherein said buoyant member is caused to move said overflow indicator in response to the level of wastewater in said vessel.

11. The device of claim 10, wherein said top surface further includes a second opening capable of receiving said second end of said overflow conduit.

* * * * *